United States Patent [19]

Mierzejewski

[11] 4,361,088

[45] Nov. 30, 1982

[54] APPARATUS FOR SCREEN PRINTING

[76] Inventor: Garret S. Mierzejewski, 49 Pollard St., North Billerica, Mass. 01862

[21] Appl. No.: 250,279

[22] Filed: Apr. 2, 1981

[51] Int. Cl.[3] ..... B41L 13/18; B05C 17/04

[52] U.S. Cl. ..... 101/124; 101/38 R; 101/126

[58] Field of Search ..... 101/38 R, 38 A, 124, 101/121, 7, 22, 39, 125, 126

[56] References Cited

U.S. PATENT DOCUMENTS

| | | | |
|---|---|---|---|
| 1,930,153 | 10/1933 | Smith | 101/124 |
| 2,237,168 | 4/1941 | Smith | 101/124 |
| 3,897,725 | 8/1975 | Derrickson | 101/38 R |

*Primary Examiner*—Richard J. Apley
*Assistant Examiner*—A. Heinz
*Attorney, Agent, or Firm*—E. Thorpe Barrett

[57] ABSTRACT

Apparatus for screen printing on cylindrical surfaces in which the driving force is created by rotation of the object to be imprinted. The force is transmitted by a belt mechanism and by direct friction between the object being printed and the stencil frame. The stencil frame is mounted for linear movement with minimum yawing and with freedom for vertical movement as required. The printer has particular advantage when the object being printed has a large moment of inertia or is circumferentially unbalanced.

6 Claims, 5 Drawing Figures

APPARATUS FOR SCREEN PRINTING

BACKGROUND OF THE INVENTION

1. Field of the Invention

This invention relates to screen printing and in particular to apparatus for screen printing on round objects and in which the surface of the object to be printed rotates in synchronism with the linear movement of the screen.

2. Description of the Prior Art

In most apparatus for screen printing on cylindrical surfaces, the object to be imprinted is supported so that it is free to rotate. A screen stencil is positioned tangentially to the cylindrical surface and is then moved laterally while the friction between the stencil and the surface of the object causes the object to rotate as the printing ink is forced through the design openings in the screen.

In another arrangement, such as that shown by Smith in U.S. Pat. No. 1,930,153, the object to be imprinted is supported on a pair of rollers which are driven by frictional contact with a belt held under spring tension. The belt is secured at its ends to the frame that supports the stencil so that lateral movement of the stencil frame causes the stencil screen to move laterally in synchronism with the rotation of the object. The driving force of the printing assembly is produced by movement of the stencil.

SUMMARY OF THE INVENTION

In the present invention the driving force is created by rotation of the object to be imprinted. This driving force, through a belt mechanism and direct friction, moves the stencil frame laterally as the object is rotated. Such an arrangement has particular advantage when the object to be printed is heavy, has a large moment of rotation, or is circumferentially unbalanced. The belt mechanism is inelastic in its longitudinal direction so that a maximum degree of synchronization is maintained resulting in high fidelity printing particularly important in multi-color reproduction requiring close registration.

DESCRIPTION OF THE PREFERRED EMBODIMENTS

Figure 1:
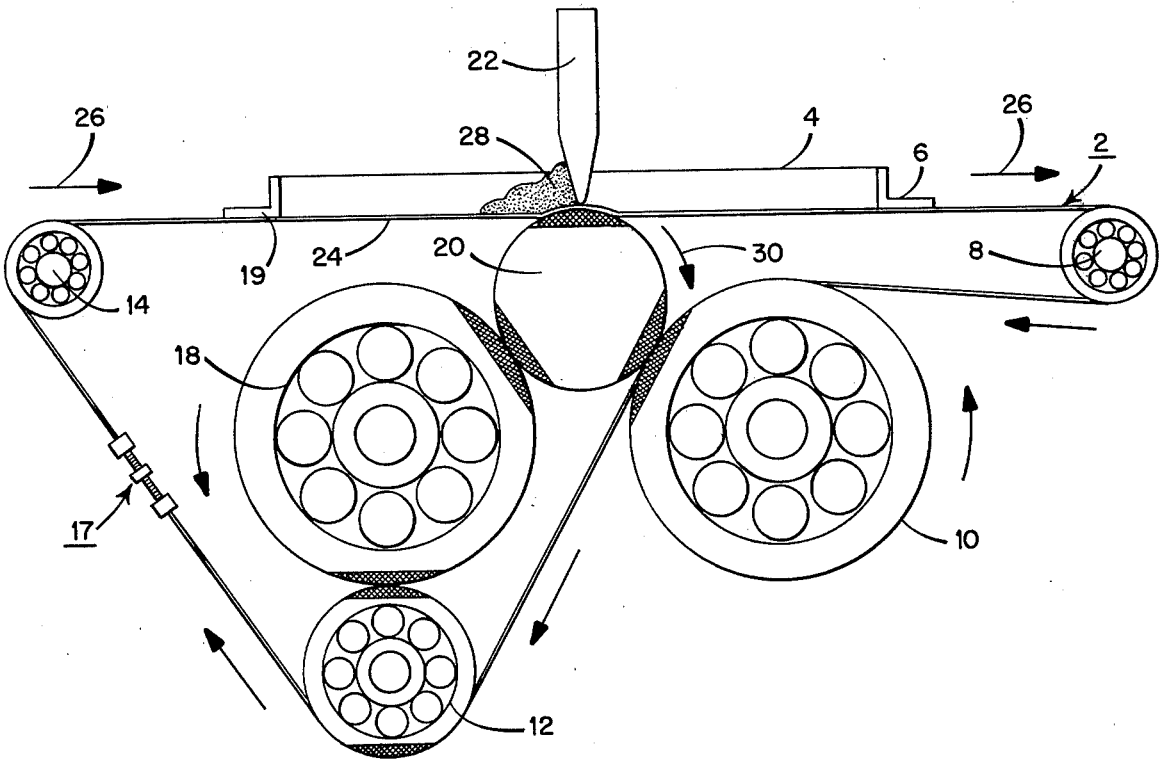
FIG. 1 is a diagrammatic representation of a screen printer embodying the invention.

As illustrated in FIG. 1, a drive belt, generally indicated at 2, is releasably connected to one end of a stencil frame 4 along the line indicated at 6 and passes around a forward outer roller 8, over a forward support roller 10, around the lower surface of an auxiliary roller 12, and around a rear outer roller 14 to the opposite end of the stencil frame 4 where it is connected as shown at 16. To permit the length of the belt to be adjusted and eliminate slack in the drive system, an adjustable connector, generally shown at 17, is connected in series with the belt 2. This adjustment, which is tightened after the stencil frame is in position, permits variation in the length of the belt to remove any slack and eliminate lost motion in the drive mechanism.

A rear support roller 18, in frictional engagement with the auxiliary roller 12, is aligned with and spaced from the forward support roller 10. The surfaces of the forward support roller 10 and the auxiliary roller 12 are provided with an outer surface having a relatively high coefficient of friction to provide traction for the belt 2. The surface of the rear support roller is also provided with a high friction surface that eliminates slippage between that roller and the auxiliary pulley 12. Friction drive areas are cross-hatched in FIG. 1.

In use, a right cylindrical object 20 to be imprinted is positioned between the support rollers 10 and 18 so that the surface of the object engages the surface of the roller 18 and the surface of the belt 2 opposite the adjacent surface of the forward support roller 10. The surface of the belt 2 should have a sufficiently high coefficient of friction that there is no slippage between the surface of the object 20 and the belt 2, or between the object and the surface of the rear support roller 18, when the object 20 is rotated.

To permit loading the object into the printer, the belt 2 is disconnected from the stencil frame 4 and the frame is removed. A squeegee 22 is hinged for vertical movement to permit quick and easy removal of the stencil frame. The stencil is conventional and comprises the rectangular frame 4 with a screen 24, of mesh, cloth or other material having appropriately small openings, stretched taut over the lower opening of the frame. The openings in the screen are sealed in all areas except those representing the design to be imprinted.

Figure 5:
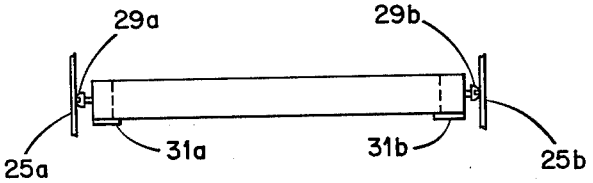
FIG. 5 is an illustrative partial sectional view of the structure for supporting and guiding the stencil frame.

After the object 20 is placed on the support rollers 10 and 18, the stencil frame is connected between the ends of the belt 2 and positioned to allow adequate distance for lateral movement of the stencil in the direction of the arrows 26. The frame 4 may be supported by runners or guides to maintain proper spacing from the surface of the object to be imprinted. Suitable support means to permit precise rectilinear movement of the stencil are well known in the art. It is desired, however, that the guide means not interfere with the frictional contact between the stencil frame and the object being imprinted. An advantageous arrangement, illustrated in FIG. 5, makes use of two rigidly mounted parallel side members **25*a* and 25*b* that guide the movement of the frame in a horizontal direction while permitting the necessary vertical movement of the frame. Each side of the stencil frame is provided with two outwardly extending machine screws, as illustrated at 29*a* and 29*b*, arranged so the heads of the screws engage and slide along the inner surfaces of the side members 25*a* and 25*b***, respectively. The two screws on each side of the stencil frame are positioned respectively near the front and rear of the frame so that when the screws are adjusted to engage the side members, the stencil form is permitted to move linearly in a horizontal direction and to move vertically to permit the desired pressure between the screen and the object and to prevent yawning in the horizontal plane.

The belt 2 is tightened, to remove any slack and insure simultaneous movement of all components, and locked in that position by the length adjusting device 17. A suitable amount of printing ink 28 is placed on the screen 24 and the squeegee 22 is lowered and flexes the screen 24 into contact with object 20. A predetermined force is maintained between the stencil frame and the object, by any desired clamping arrangement (not shown) so that the desired amount of friction exists between the object and the stencil frame and between the object and the belt drive system. To increase the friction between the frame 4 and the object 20 to be imprinted, two strips 31*a* and 31*b* (FIG. 5) of double-sided non-drying adhesive tape are secured lengthwise along the bottom surfaces of the side members of the frame 4. When the object 20 is rotated in the direction indicated by the arrow 30, the frictional engagement between the surface of the object 20 and the support roller 18 and belt 2, along with the friction provided by the stencil frame, causes the surfaces of the rollers 10 and 18 and the belt 2 to move at the same linear speed as the surface of the object and the screen of the stencil. An additional driving force is applied to the belt by the auxiliary pulley 12 which is in frictional engagement with the rear support roller 18 and the belt 2. The stencil frame 4 is thus caused to move at a speed corresponding to the surface velocity of the object 20 to provide a clear and precise imprint with registration adequate for detailed multi-color printing.

The distance between the forward and rear outer rollers 8 and 14 depends upon the length of the image to be imprinted and must be such as to allow adequate movement of the stencil frame 4 to imprint the object.

Advantageously, the support rollers 10 and 18 are of a diameter substantially larger than the diameter of the object to be imprinted since the driving force originates by rotation of the object 20. If the support rollers were smaller than the diameter of the object to be imprinted, an even greater coefficient of friction could be required to drive the mechanism, and it is thus to be preferred that the diameter of the rear support roller 18 be at least as great as the diameter of the object to provide maximum surface contact between the object and the roller, and that the forward roller have a corresponding diameter to provide maximum contact between the object and the belt and between the belt and the roller 10.

It will be noted that in the arrangement described, the stencil frame 4 and its screen 24 are subjected to minimum transverse loading so that the image is not distorted by the driving forces. In arrangements where the driving force is applied to the stencil frame and movement of the frame causes the object to rotate, problems may arise because of image distortion. Even more serious problems arise where the object to be imprinted is heavy or has a large rotational moment of inertia and the necessarily large forces of acceleration and deceleration must be transmitted from the stencil frame. If the object to be imprinted is unbalanced, as when printing a logo on a bicycle frame, such a system becomes inoperative. The unbalance may be corrected by appropriate counter balancing, but the resulting increase in the inertia of the object results in other difficulties.

In the illustrative arrangement described in connection with FIG. 1, a single drive belt is used. In practice, however, it is preferred to use two drive belts positioned outside of and on opposite sides of the image area. It is also preferable to provide support for the object being imprinted only outside the area of the image. With this arrangement, the full circumference of the object can be imprinted without smudging.

Figure 2:
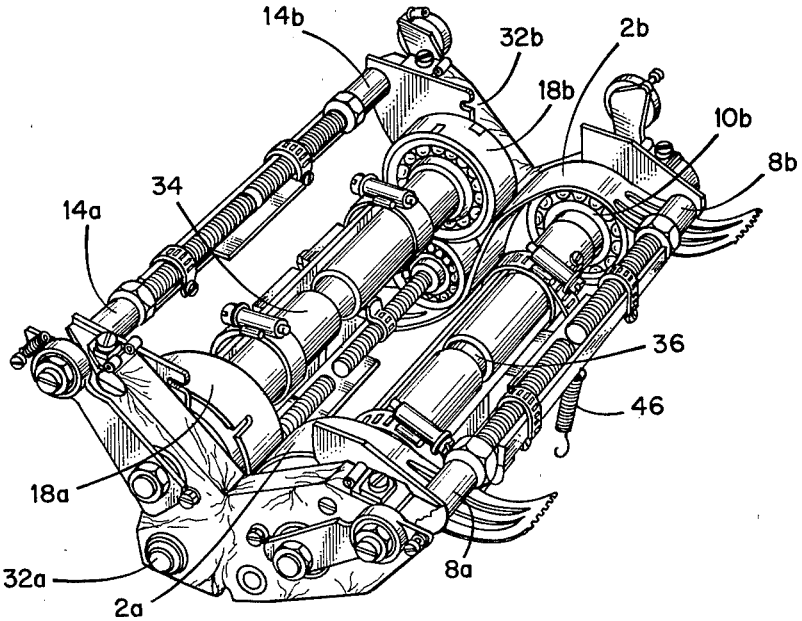
FIG. 2 is a perspective view of the under assembly of a screen printer of the type illustrated in FIG. 1.
Figure 3:
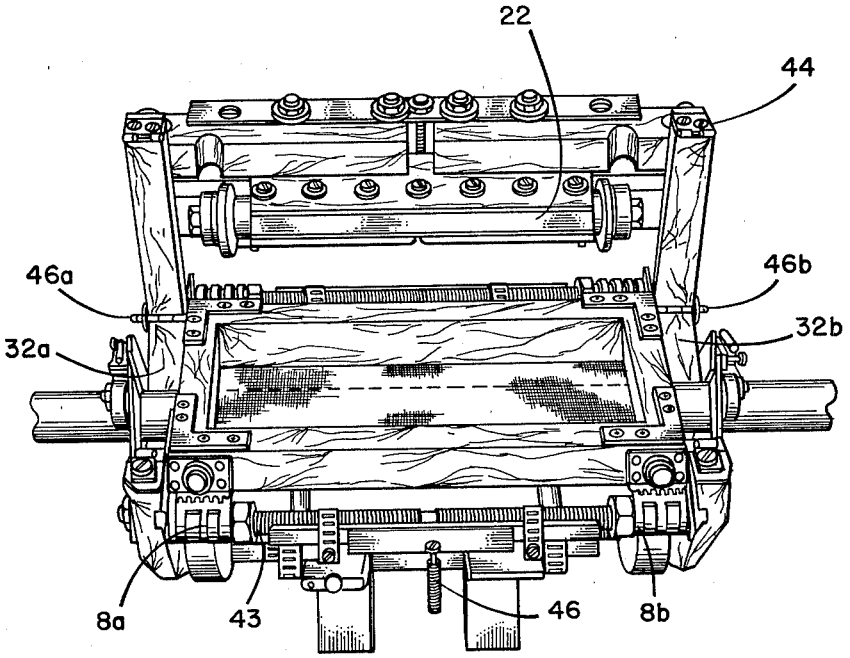
FIG. 3 is a front view of the printer with the screen assembly in position and the squeegee in open position.
Figure 4:
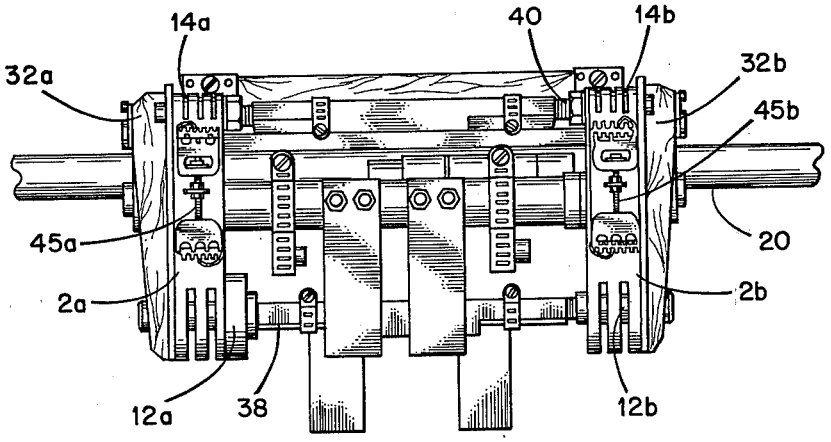
FIG. 4 is a rear view of the printer with the stencil frame attached.

As shown in FIGS. 2, 3, and 4, a frame assembly having generally V-shaped end support panels 32*a* and 32*b* provides the mounting for the moving parts of the assembly. Two rear support rollers 18*a* and 18*b*, positioned on opposite sides of the image area, are rotatably supported on a shaft 34 that extends between the end panels 32*a* and 32*b*. The side members 25*a* and 25*b* of FIG. 5 may comprise metal plates secured to the end plates 32*a* and 32*b*, or the end plates may be shaped so that they themselves serve as the side guide members.

The surfaces of the rollers 18*a* and 18*b*, as with the roller 18 in FIG. 1, may be covered with the same material as the belt to provide the desired coefficient of friction. Two similar oppositely-disposed forward support rollers 10*a* and 10*b* are rotatably mounted on a shaft 36 that extends between the end panels 32*a* and 32*b*. Only one of these rollers, 10*b*, is visible in FIG. 2 in position to engage the belt 2*b*. The corresponding roller on the other side similarly engages the belt 2*a*. Two auxiliary rollers 12*a* and 12*b* (see FIG. 4), in similar spaced positions, are rotatably mounted on a shaft 38 extending between the end panels 32*a* and 32*b*. The rear outer rollers 14*a* and 14*b* are mounted on a shaft 40 extending between the panels. The forward outer rollers 8*a* and 8*b* are mounted on a shaft 43 extending between the end panels.

The two belts 2*a* and 2*b*, each following a path corresponding to the path of the belt 2 as illustrated by FIG. 1, are arranged on opposite sides of the image area and are arranged to be secured to opposite ends of the frame 4. A belt tightening device 45*a* and 45*b* corresponding to the adjustment device 17 of FIG. 1 is provided for each of the belts.

The object to be imprinted is positioned transversely across and within the V-notches of the end panels 32*a* and 32*b* and rests, on one side of the image area, on the rear support roller 18*a* and the surface of the belt 2*a* adjacent the forward support roller 10*a*. On the opposite side of the image area the object rests upon the rear support roller 18*b* and the surface of the belt 2*b* adjacent the surface of the forward support roller 10*b*.

After the object 20 has been positioned, the stencil frame is placed on the top of the assembly and the forward ends of the two belts 2*a* and 2*b* (FIG. 3) are attached to the forward end of the frame 4. The other ends of the belts 2*a* and 2*b* are secured to the rear of the frame 4. For convenience in use, each end of each belt is preferably secured to the screen frame by a quick release hasp that will permit the frame to be removed readily and will not interfere with the movement of the frame during the printing operation. The frame 4 is positioned toward the rear of the assembly so that as it is moved forward by rotation of the object 20, the image will be imprinted in the desired location on the object 20.

The squeegee 22 is mounted transversely on a supporting frame 44 that is hinged at the rear by piano type hinges 46*a* and 46*b* to the end support panels 32*a* and 32*b* respectively.

After the printing ink has been placed on the screen 24, the squeegee support frame 44 is lowered, the appropriate adjustments are made to secure the necessary vertical load on the frame to provide sufficient friction, and a centrally located coil spring 46 secured at one end to the frame assembly is connected to the forward end of the squeegee frame 44. (The spring 46 is shown in its disconnected position in FIG. 3.) The spring is adjusted to provide the necessary pressure to cause the stencil screen to engage the object to be imprinted.

When the object to be imprinted is unbalanced, the addition of counter-weights will permit more uniform motion of the printing mechanism. Such counterbalanced objects are usually heavy and may have outwardly extending components or arms, as with a bicycle frame, either of which causes a large rotational moment of inertia and renders ineffective those arrangements where the motive power is applied to the screen or belt assembly rather than to the object being imprinted.

Various additions, modifications and adaptations may be made without departing from the spirit of the invention. The entire assembly may be secured to a permanent base or supports may be added to the frame assembly to permit it to be clamped in a bench vise when in use. Provision may be made for using stencil frames of different widths by arranging suitable adjustments to alter the distance between the end support panels 32*a* and 32*b*. Adjustments may also be provided to permit imprinting on objects of various diameters. For example, adjustments may be provided to permit raising and lowering the frame 4 by adjustment of the tracks or guides on which the frame rests. When heavier or unbalanced objects are being imprinted, it is particularly desirable that locking arrangements be provided on each of the end assemblies so that the center of rotation of the object being imprinted is maintained in a precise location throughout the printing process. Such locking rings may be adjustable in diameter to permit imprinting objects of different diameters. In an alternative arrangement, clamps may be secured to the object with three or more outwardly-extending adjustable screws that ride on a suitable ring surface or directly on the surfaces of the V-shaped openings in the two end support panels.

For precise printing, it is desirable that spring arrangements in series with the belts 2*a* and 2*b*, as shown in the above-identified patent to Smith, be avoided because the first action as printing movement is started is to incrementally stretch the springs and thus prevent the simultaneous starting of motion throughout the drive system. A preferred arrangement is that shown in FIG. 1 in which the screw adjustment is arranged in a slot so that after the stencil is in position, the belt can be tightened and locked in position. Alternative belt tightening arrangements can be used such as changing the lateral position of one of the shafts supporting the outer rollers 8*a* and 8*b* or rollers 14*a* and 14*b*. As mentioned previously, it is desirable that the belt system be inelastic and that series spring elements be avoided. By an inelastic belt system is meant a belt arrangement having no more elasticity than that normally associated with a conventional belt arrangement using conventional belt materials without series springs or other expandable series objects.

The particular arrangement described is ideally suited for imprinting logos or names on bicycle frames, but is adaptable for many other purposes.

From the foregoing it will be seen that my invention is well adapted to attain the ends and objects herein set forth, that it is practical in use and can be manufactured at acceptable cost levels.

I claim:

1. In a screen printing apparatus for printing on an object having a substantially circular cross section defining a curved surface, the improvement comprising a stencil assembly having a defined image printing area including;

a printing screen and a frame supporting said screen, means supporting said stencil assembly for rectilinear movement, rotatable means for supporting the object to be imprinted, and means responsive to an external rotational force applied to said object arranged to move said screen linearly at a velocity equal to the circumferential velocity of the surface to be imprinted comprising at least one elongating belt connected to said stencil assembly and in engagement with the surface of the object to be imprinted.

2. Apparatus as claimed in claim 1 wherein said object is rotatably supported by two rollers at least one of which has a diameter at least as great as the object being imprinted.

3. Apparatus as claimed in claim 1 wherein said stencil assembly is in frictional engagement with the surface of the object to be imprinted outside the said image printing area of said stencil assembly.

4. Apparatus as claimed in claim 3 wherein said belt is positioned adjacent and outside the said image printing area of said stencil assembly.

5. Apparatus as claimed in claim 4 wherein said rotatable means for supporting said object includes a pair of parallel rollers, one of said rollers being in engagement with said object and wherein the said belt is interposed between the other of said rollers and said object.

6. Apparatus as claimed in claim 5 including a pair of strips of material having a high-friction surface positioned along the underside of said frame near its outside edges.

* * * * *